United States Patent [19]

Trout et al.

[11] Patent Number: 4,509,884

[45] Date of Patent: Apr. 9, 1985

[54] INJECTION NOZZLE FOR ADHESIVE MATERIALS

[75] Inventors: John F. Trout, West Chicago, Ill.; John J. Hoffman, South Bend, Ind.

[73] Assignee: Lily Corporation, Chicago, Ill.

[21] Appl. No.: 490,459

[22] Filed: May 2, 1983

[51] Int. Cl.[3] ..... B65B 3/04; B29F 1/00; E02D 5/18; E04G 23/02

[52] U.S. Cl. ..... 405/269; 52/744; 141/293; 141/311 R; 425/13; 425/568

[58] Field of Search ..... 405/229, 240, 241, 258, 405/260, 266, 269; 52/514, 704, 743, 744, 749; 425/11-13, 568, DIG. 227; 141/177, 280, 293, 311 R, 374, 392

[56] References Cited

U.S. PATENT DOCUMENTS

| | | | |
|---|---|---|---|
| 2,860,489 | 11/1958 | Townsend | 405/269 |
| 2,930,199 | 3/1960 | Järund | 52/744 X |
| 3,359,742 | 12/1967 | Blatter | 405/260 |
| 3,379,019 | 4/1968 | Williams | 52/704 X |
| 3,541,797 | 11/1970 | Stewart | 405/269 |
| 4,074,735 | 2/1978 | McCabe | 405/269 X |
| 4,252,474 | 2/1981 | Botes | 405/260 X |
| 4,352,262 | 10/1982 | Edelmann | 52/744 |
| 4,382,720 | 5/1983 | Vonach | 405/269 |

FOREIGN PATENT DOCUMENTS

| | | | |
|---|---|---|---|
| 7702951 | 3/1976 | Netherlands | 405/269 |
| 7085 | of 1914 | United Kingdom | 405/269 |
| 285620 | 3/1971 | U.S.S.R. | 405/269 |
| 509689 | 6/1976 | U.S.S.R. | 405/269 |
| 876840 | 11/1981 | U.S.S.R. | 405/269 |

*Primary Examiner*—Cornelius J. Husar
*Assistant Examiner*—Nancy J. Stodola
*Attorney, Agent, or Firm*—Marmaduke A. Hobbs

[57] ABSTRACT

A nozzle for injecting adhesive materials into cracks in concrete, mortared joints in brick or stone walls, in timber, or in similar materials, the nozzle having a body with a center channel for conducting the resin from a suitable pump into the cracked surface. The nozzle may be surface mounted or mounted in a drilled hole, and has a proximal end adapted for connection to a conventional coupling and a distal end surrounded by spaced lugs which facilitate insertion of the distal end into a hole and aid in retaining the nozzle therein. The spacing between the lugs and a plurality of grooves in the distal end communicating with the center channel minimize back pressure when surface mounted and resist back pressure when mounted in a hole, and provide an even diffusion of the resin into the void. A collar is normally provided near the distal end for partially or completely sealing the installation and for retaining an adhesive gel or putty cone which further seals the installation. The collar may also serve as an abutment against which a suitable driver can be placed to drive the nozzle into a hole.

5 Claims, 6 Drawing Figures

INJECTION NOZZLE FOR ADHESIVE MATERIALS

BACKGROUND OF THE INVENTION

Concrete finds extensive use as a building material due to its durability, strength, and ability to assume various shapes in its semi-fluid state before hardening. One serious and common problem encountered where concrete has been used is the cracking which occurs in the material over time due to such factors as freezing and thawing, ground settling, improper mix, improper application, and general deterioration with age. Similar problems are encountered with mortared joints between bricks, concrete blocks or stone, and with timber used in construction. Previously, these cracks have been repaired by removing areas surrounding the cracks, if possible, and filling the cracks with new concrete or mortar applied in the resulting cavity, usually using a trowel or similar instrument, at considerable expense if the repairs could be made at all. Another problem occurs where laminated construction methods are used for bridge decks, parking garages, and similar structures. Improper design and installation can result in delamination of the slab, which in turn causes extensive cracking, pot holes, and ultimate failure. Recently, epoxies and other polyester resins have been developed which not only adhere to the cracked material, filling voids and cavities and binding the surfaces together, but last almost indefinitely, ensuring that once a crack or cavity is properly filled, the problem at that particular area will cease to exist. Proper and prompt repair is important economically as well as structurally, since it will strengthen as well as prolong the life span of the repaired materials. Suitable dispensers have also been developed for metering, mixing and delivering these resins to the cracked surfaces at pressures in excess of 300 psi. However, many problems still exist in injecting the resins into the concrete, timber, or other material, since the techniques and tools used for the porting operation remain relatively undeveloped.

Regardless of the precise porting method selected, it is always necessary to first seal the crack or fault at the surface to contain the resin which is subsequently injected therein. This is normally accomplished by applying an epoxy paste or gel or a fast-setting cement mortar over the crack, usually with a spatula or putty knife. One of the most common methods of porting currently in use where the cracks are relatively free of impacted debris at the surface involves leaving a $\frac{1}{4}''$ wide gap in the paste used to seal the crack at the surface and setting a steel washer in this gap against the surface to be filled, held thereon by the paste. Following cure of the paste, a rigid $\frac{1}{4}''$ O.D. tube with a grommet on the end is manually held against the smooth seat provided by the washer while the resin is injected into the crack. A variation of this procedure involves setting an item such as a toothpick in the crack, which is then removed after the paste or gel is applied, leaving a hole through or against which a tube is placed and resin is injected.

This procedure requires that the tube be held in place using constant pressure while the fault is being filled, since any decrease in the holding pressure will result in leakage. However, the normally high-pressured injections used for these procedures are not easily contained by manually holding the tube against the surface to be injected. Where a relatively narrow crack is being filled, it may be necessary to apply pressure and hold the tube against the surface for ten minutes or more, due to the slow diffusion through the narrow fault, making the quality of the installation directly dependent upon the patience, strength, and stamina of the holder. Another method of porting commonly used where dirt and other contaminants have been driven into the fault at the surface involves drilling holes, approximately $\frac{1}{2}''$ in diameter, to a depth of approximately $\frac{1}{2}''$. These holes are drilled directly over the fault, normally using a waterflushed core or masonry bit or a hollow vacuumed bit to avoid impacting the removed material into the fault. A copper or plastic tube is then inserted into the hole and sealed with an adhesive gel or paste cone. The connection to the resin dispenser is made using a hose clamp, or by inserting a tapered plastic nozzle into the inserted tube and holding it therein for the duration of the injection process.

Once the injection of resin has been completed, the installation site is sealed, either by rubbing a paraffin block over the $\frac{1}{4}''$ area left uncovered in the first mentioned procedure, replacing the toothpick or similar item in the hole, or, where tubing has been used, by placing a plug or a cap on the tube to keep the injected resin in place. Where a fault is incorrectly or inadequately filled during the initial effort, it is normally impossible to re-inject the fault, since the previously injected and catalyzed resin prevents the injection of fresh adhesive. Thus, the anticipated repair strengths can not be realized and unsatisfactory results are obtained.

SUMMARY OF THE INVENTION

It is, therefore, one of the principal objects of the present invention to provide a nozzle for injecting epoxies or polyester resins into cracks in concrete, into mortared joints between bricks or stone, or into cracks in timber, which can be easily secured and centered in a hole provided at or near the crack, or which can be easily surface mounted on the concrete or other surface for injecting the adhesive into the voids.

An additional object of the present invention is to provide a nozzle for injecting epoxy or resin into cracks and other voids, which has been designed to minimize problems with back pressure which tends to force conventional nozzles out of their mounting holes, and which accepts and is easily sealed by an adhesive gel or putty cone, thereby facilitating complete filling of the cracks, cavities or other voids.

A further object of the present invention is to provide a nozzle for injecting epoxy or resin which can be economically fabricated using a plastic material, such as nylon, which is easily sealed with a conventional clamp or hemostat after the pressurized resin has been injected into the fissure, and which can be easily and securely coupled to a universal coupling for connection to a resin pumping device.

These and other objects are attained in the present invention, which relates to a nozzle for injecting epoxy or polyester resin material into cracks, fissures or other voids in concrete or other building materials, the nozzle preferably having a hollow body member with a proximal end adapted for connection to a universal coupling which is connected to a suitable resin dispenser. The distal end is normally provided with gripping means designed to facilitate insertion of the nozzle tip into a hole and to aid in retaining the nozzle in the hole. A collar or sealing means is normally used, which aids in preventing escape of the injected resin and assists in retaining the adhesive gel or putty cone in place, and which serves as an abutment against which a suitable driver may be placed to drive the nozzle into the hole. The nozzle has been designed to minimize back pressure when surface mounted, and to resist back pressure when mounted in a hole. These aims are accomplished using the design configuration of the inserted end, one embodiment having a collar with a plurality of grooves surrounding and in communication with the center channel of the body of the nozzle, thus facilitating complete and even diffusion of the adhesive into the voids.

DETAILED DESCRIPTION OF THE PREFERRED EMBODIMENT

Figure 1:
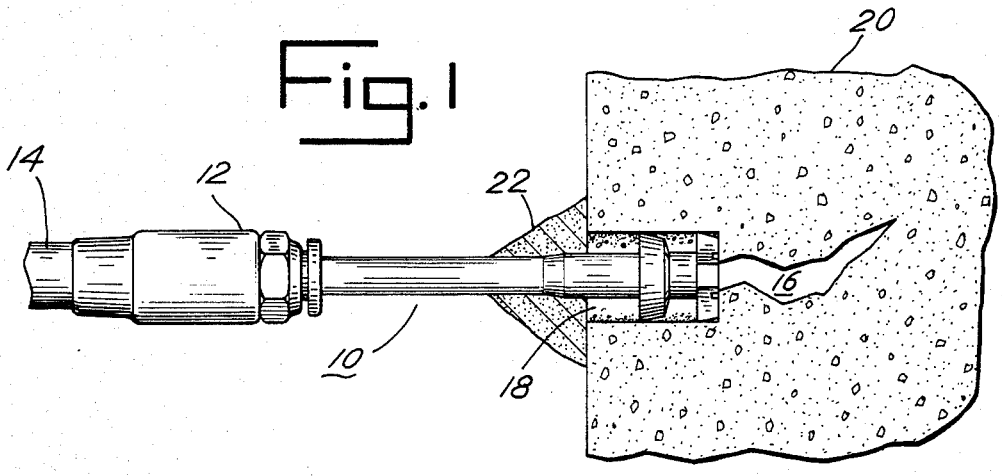
FIG. 1 is a side elevational view of the injection nozzle embodying the present invention shown in its installed position in a section of concrete having a crack to be filled, the concrete being shown in cross-section.
Figure 2:
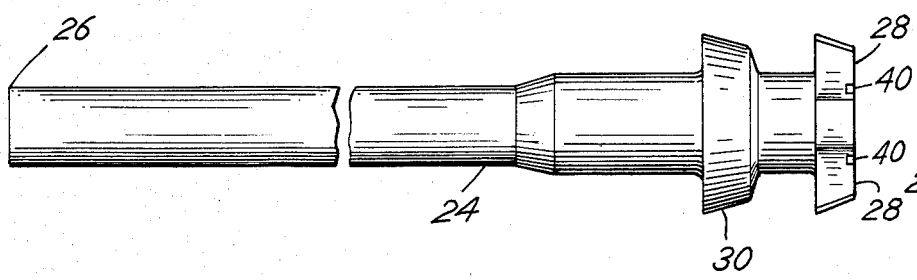
FIG. 2 is an enlarged side elevational view of the injection nozzle shown in FIG. 1, shown here apart from its installed position.
Figure 5:
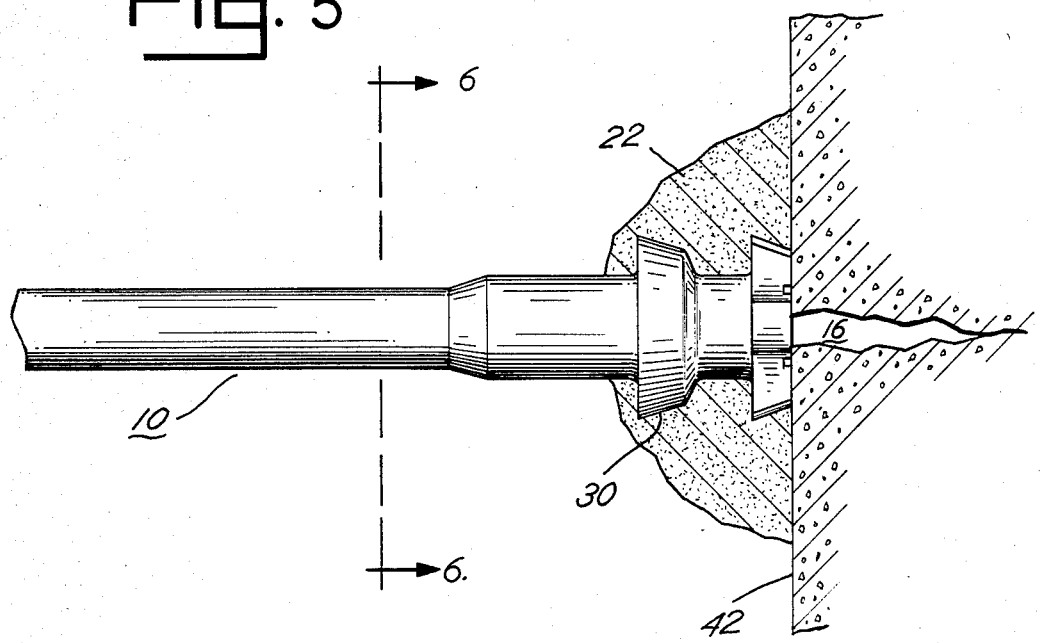
FIG. 5 is an enlarged side elevational view of the nozzle, shown surface mounted on a section of concrete wall having a crack to be filled.
Figure 6:
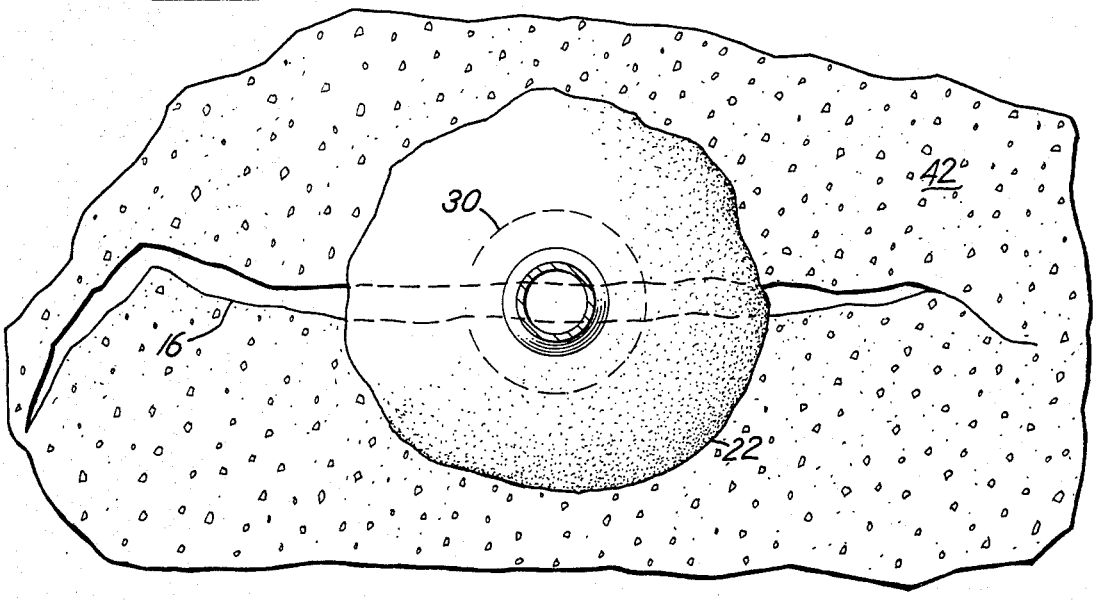
FIG. 6 is an elevational view of the concrete wall and nozzle installation shown in FIG. 5, with the nozzle being shown in cross-section, the section being taken on line 6—6 of FIG. 5.

Referring more specifically to the drawings, and to FIG. 1 in particular, numeral 10 designates generally the injection nozzle embodying the present invention, the nozzle being shown connected to a conventional and widely-available coupling 12, which is connected to a suitable epoxy dispenser (not shown) through hose 14. The procedure followed in filling cracks or cavities 16 varies according to the size and severity of the crack to be filled. The nozzle may be inserted into a hole 18 which has been drilled in the concrete 20 and washed to remove loose debris, as shown in FIG. 1, or it may be surface-mounted as shown in FIG. 5. In either case, an adhesive gel or putty cone 22 is applied around the body of the nozzle to aid in sealing the installation. As noted, the present invention can be used for filling cracks in concrete, in mortared joints such as in brick or concrete block walls, in timber or in similar materials.

Figure 3:
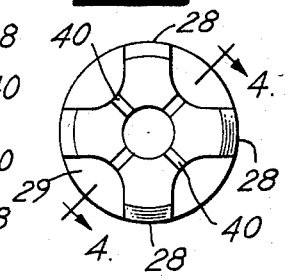
FIG. 3 is an enlarged end view of the nozzle shown in the preceding figures, illustrating the distal end which contacts the concrete or other material to be repaired.
Figure 4:
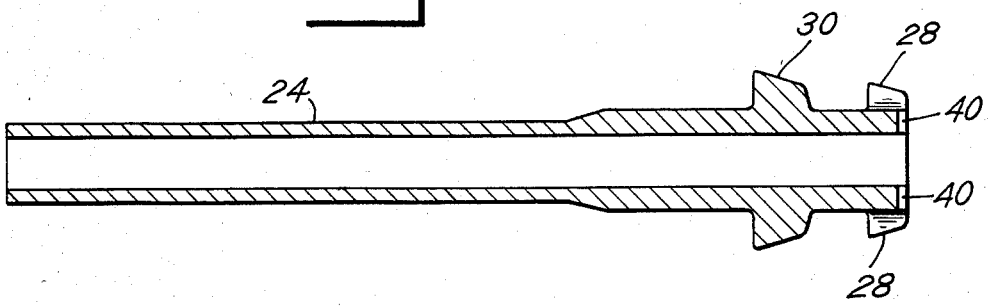
FIG. 4 is an enlarged cross-sectional view of the nozzle shown in the preceding figures, the section being taken on line 4—4 of FIG. 3.

The nozzle has a main body portion 24 with a center channel through which the epoxy or resin is pumped into the cracked material. The proximal end 26 has been designed for connection to a conventional coupling 12, which is connected to the resin dispenser. A plurality of lugs 28 are disposed and regularly spaced around the distal end of the nozzle with slots 29 therebetween, as shown in FIG. 3. Slightly recessed from the distal end and the lugs is a tapered collar 30 which may serve as a complete seal or as a partial seal in conjunction with the gel or putty cone when the nozzle is inserted into a hole, or as a means to retain the adhesive gel or putty cone when the nozzle is surface-mounted. The collar also serves as an abutment means against which a suitable press or driver, such as a wooden awl-type handle containing a rigid sleeve or a hollow metal tube, can be placed to press or drive the nozzle into a hole.

Where the nozzle is to be used for filling a relatively narrow crack, or one in which the crack is heavily impacted with debris, a hole is drilled having a slightly smaller diameter than the diameter of the distal end, including the lugs, the drilled holes normally measuring approximately one-half inch, although variations may be dictated by the particular material to be filled and the extent of the cracked area. The slotted configuration of the distal end reduces the surface area in contact with the concrete by as much as 25%, thereby facilitating the insertion of this end into the hole. As the nozzle is pressed or driven into the hole, the edges of the lugs, which are shown as tapered inwardly toward the end, are rolled slightly rearwardly and tightly compressed against the sides of the hole, providing a snug fit and a centered installation. This design configuration provides a further advantage, since most field-drilled holes are slightly widened at the surface but tend to firm up as the drilling proceeds, due to the difficulty encountered in beginning the hole. The reduced surface area of the lugs enables them to be more easily driven into the tight space at the base of the hole, while the full collar provides an additional measure of security near the widened surface of the hole.

Complete and even distribution of the resin into the voids is facilitated by a plurality of grooves 40 which are in communication with and extend radially from the center channel in the body of the nozzle to the slots 29 between the lugs. This feature assures resin flow into the fault, even where the distal end of the nozzle is firmly set against the base of the hole, or where the center channel is not aligned directly over the crack, by permitting the resin to occupy and flow throughout the annular area between the lugs 28 and the collar 30. This is a significant advantage when injecting hairline cracks which may measure only 0.002 inches, because the orifice into the crack is substantially increased over that of conventional nozzles and allows resin to flow axially forward and laterally into the crack, assuring complete filling throughout its depth and width up to and including the areas adjacent the surface.

Where the fissure or crack to be filled is free from impacted debris and of sufficient dimension to allow reasonably free flow of the resin, the nozzle 10 may be surface mounted, as shown in FIG. 5, where the nozzle is mounted on a section of concrete 42. In these instances, a suitable adhesive, such as a cyanoacrylate-type adhesive, is applied to the outer surface of the lugs 28 and the nozzle is bonded to the concrete or other surface to be filled, with the center channel aligned over a segment of the crack 16. The glue holds the nozzle on the concrete while the adhesive gel or putty cone 22 is applied around the nozzle, over and against the lugs and the collar 30 to firmly anchor the nozzle in place and seal the injection site. The configuration given the lugs reduces the surface mounted area by over 25% as opposed to a full ½" diameter mounting as is necessary with conventional nozzles. This reduction in base area results in reduced back pressure due to the occupation of the laminate area by the pressurized resin. Further reduction in back pressure is provided once the gel or paste adhesive is applied over this laminate area. The lateral extension of the lugs increases the bonding area for the cyanoacrylate-type adhesive by as much as 26% over conventional nozzles, significantly increasing the bond of the nozzle to the surface. The above factors provide substantial advantages over conventional devices, since injection of the resin may occur at pressures as high as 300 psi. The security of the mounting is maintained by the designed wall thickness and the flexible material used to construct the nozzle. The flexibility of the body of the nozzle minimizes strain on the bond during manipulation of the body when connecting it to a coupling for dispensing resin, and also when disconnecting the coupling and crimping the body after injection.

In the use and operation of the injection nozzle embodying the present invention, the surface to be filled is first inspected to determine whether surface mounting or mounting in a drilled hole is necessary. Surface mounting is accomplished in the manner just described with a suitable adhesive applied to the end surface of the lugs 28, whereupon the nozzle is bonded to the surface of the material to be filled. Where the fissure or crack is heavily impacted with debris or is very narrow at the surface, a drill with a masonry bit or core bit, for example, is used to bore a hole and the nozzle is pressed or driven into this hole, held and centered therein by the slightly compressed lugs 28 and the collar 30 which may serve as a complete or a partial seal. In both of these applications, an adhesive gel or putty cone is normally applied around the body 24 of the nozzle to firmly bond the nozzle to the cracked surface and complete the seal. The proximal end 26 of the nozzle is then connected to a conventional coupling, and the epoxy or other resin is pumped through the center channel of the nozzle into the void in the cracked material. The slots 29 between the lugs reduce or resist back pressure which tends to force conventional nozzles or tubes away from the cracked surface, and the grooves 40 permit a complete and even distribution of the resin into the void by substantially increasing the orifice into the crack. Once the void is filled, a clamp is used to crimp the body of the nozzle, preventing the escape of the adhesive from the injected void, and the coupling is disconnected from the nozzle. The nozzle is left in place until the resin solidifies, whereupon the adhesive gel cone may be removed and the protruding end of the nozzle may be cut off, normally flush with the concrete or other surface if possible, or the nozzle and cone may be simply left in place.

Horizontal faults, which can occur where laminated construction methods are used for building bridges and the like, are repaired in a somewhat similar manner. The bridge, for example, is tested to discover faults by a method such as dragging a heavy chain over the bridge surface and marking the areas which sound hollow. A hole is then drilled near the marked area down to the level of the fault and the present nozzle is inserted therein and sealed by an adhesive gel cone as previously described. In some cases, where the tolerance between the drilled hole and the collar 30 is sufficiently close, a relatively large area is being filled, as with defective laminated concrete, and only moderate pressure is required to completely dispense the resin into the void, the seal provided by the collar against the sides of the hole will be sufficient to seal the injection site and a gel or paste cone is unnecessary. This feature presents significant advantages in terms of the time required to complete the installation and the labor costs involved. Resin is pumped into the fault until it is completely filled, as indicated by negative tests for hollowness or by drilling a second hole near the first one to serve as an indicator.

While only embodiment of an injection nozzle for sealant materials has been shown and described in detail herein, various changes and modifications may be made without departing from the scope of the invention.

I claim:

1. A nozzle for injecting an adhesive material into fissures and other voids intersecting a drilled hole in concrete and other building structures, comprising an elongated body portion having proximal and distal ends, said body portion having a hollow center channel connected to and communicating with said distal end for the flow of adhesive material into the drilled hole, a plurality of substantially rigid lugs extending radially outwardly on the distal end of said body portion for contacting the sides of the drilled hole, said lugs being spaced from one another to form a plurality of spaced slots for the flow of adhesive material therethrough, a plurality of spaced grooves disposed in said distal end around said channel and extending radially from said channel to said slots for evenly distributing the adhesive material, and substantially rigid collar disposed around said body portion in spaced relation to said distal end and said lugs for forming a seal with the side walls of the drilled hole.

2. A nozzle as defined in claim 1 in which said lugs extend laterally from said distal end and have inwardly tapered outer edges for facilitating introduction of said nozzle into a hole and for aiding in retaining said nozzle therein.

3. A nozzle as defined in claim 2 in which said collar has inwardly tapered outer edges forming a sealing contact with the side walls of the hole to prevent escape of the adhesive material.

4. A nozzle for injecting an adhesive material into fissures and other voids intersecting a drilled hole in concrete and other building structures, comprising an elongated cylindrical body portion of relatively rigid plastic material having proximal and distal ends, said body portion having a hollow center channel extending the length of said body portion and connected to and communicating with said distal end for the flow of adhesive material into the drilled hole, a plurality of substantially rigid lugs extending radially outwardly on the distal end of said body portion for contacting the sides of the drilled hole and guiding said body into the drilled hole, said lugs being spaced from one another to form a plurality of spaced slots for the flow of adhesive material therethrough, a plurality of grooves disposed in said distal end and extending radially outwardly from said center channel to the slots between said lugs for evenly distributing the adhesive material, and a substantially rigid collar disposed around said body portion in close proximity to but in spaced relation to said lugs for forming a seal with the side walls of the drilled hole.

5. A nozzle as defined in claim 4 in which said collar is joined integrally with said body portion near said distal end for aiding in driving said nozzle into a hole.

* * * * *